US008414415B1

(12) United States Patent
Twohig

(10) Patent No.: US 8,414,415 B1
(45) Date of Patent: Apr. 9, 2013

(54) GOLF CLUB STAND

(76) Inventor: Steven J. Twohig, Omaha, NE (US)

( * ) Notice: Subject to any disclaimer, the term of this patent is extended or adjusted under 35 U.S.C. 154(b) by 116 days.

(21) Appl. No.: 13/209,003

(22) Filed: Aug. 12, 2011

Related U.S. Application Data

(60) Provisional application No. 61/401,411, filed on Aug. 13, 2010.

(51) Int. Cl.
*A63B 55/10* (2006.01)

(52) U.S. Cl.
USPC ..... 473/282

(58) Field of Classification Search ..... 473/282
See application file for complete search history.

(56) References Cited

U.S. PATENT DOCUMENTS

| | | | | |
|---|---|---|---|---|
| 5,285,990 | A * | 2/1994 | Engel | 248/156 |
| 6,383,088 | B1 * | 5/2002 | Kershner | 473/282 |
| 7,677,989 | B2 * | 3/2010 | Fletcher | 473/282 |
| 7,854,664 | B1 * | 12/2010 | Comrie | 473/282 |

* cited by examiner

*Primary Examiner* — Michael Dennis
(74) *Attorney, Agent, or Firm* — Suiter Swantz pc llo

(57) ABSTRACT

The current disclosure describes a golf club stand used for elevating a golf club handle above the ground. The golf club stand may include, but is not limited to, a leg housing, a coupling apparatus configured to attach the leg housing to a golf club, and a leg, wherein the leg housing is configured for substantially enclosing the leg within the leg housing, the coupling apparatus is coupled to the leg housing, and the leg is connected at a first end to the leg housing in a manner that allows the leg to rotate with respect to the leg housing.

13 Claims, 4 Drawing Sheets

GOLF CLUB STAND

CROSS-REFERENCE TO RELATED APPLICATIONS

The present application claims the benefit under 35 U.S.C. §119(e) of U.S. Provisional Application Ser. No. 61/401,411, filed Aug. 13, 2010, which is incorporated herein by reference.

TECHNICAL FIELD

The present disclosure generally relates to the field of golf club accessories, and more particularly to a golf club stand.

BACKGROUND

Many golfers now use motorized carts to navigate a golf course, but many golf course owners discourage or prohibit golfers from driving motorized carts to the immediate location of the golfer's ball after a shot. This is especially true if the golf course grass has become saturated with water. Driving motorized carts on saturated grass can cause damage. Therefore many golf courses require golfers to keep the motorized vehicles upon designated cart paths. At times, this requires the golfer to walk a moderate distance to get to their ball.

Often, when a golfer begins the walk from the cart to the ball, the golfer may be unsure as to which of many golf clubs will be needed for the next golf shot. As a result, the golfer is forced to bring more than one club along as the golfer walks to the golf ball to take the next shot. Often, golfers are forced to bring more than one club with them if their ball is near a "green" but not yet on the green. (A "green" is a section of very short grass where the target hole is located). In this case, the golfer will usually bring a putting club and a chipping club. This is true even though the golfer probably knows exactly which club(s) will be used for all of the remaining shots. This is because motorized golf carts are generally disallowed within a short distance of the green regardless of the condition of the grass.

As a golfer approaches the ball with more than one golf club, the golfer is forced to choose which golf club to use to swing at the ball for the next shot. Because the golfer is away from the location of the golf club bag, the golfer must place the unselected golf club(s) upon the ground while taking the next swing at the golf ball with the selected club. The placement of the unselected club(s) upon the ground often causes dirt, gravel, sand, water and other debris to accumulate on the handle or "grip" portion of the golf club. This is especially true in the morning when dew readily accumulates upon surfaces that touch the ground. Many golfers dislike debris or moisture upon the grip of their golf clubs.

SUMMARY

The current disclosure describes a golf club stand used for elevating a golf club handle above the ground. The golf club stand may include, but is not limited to, a leg housing, a coupling apparatus for attaching the leg housing to a golf club, and a leg, wherein the leg housing is configured for substantially enclosing the leg within the leg housing, wherein the coupling apparatus for attaching the leg housing to a golf club is attached to the leg housing, wherein the leg is connected at a first end to the leg housing in a manner that allows the leg to rotate with respect to the leg housing.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to presently preferred embodiments of the disclosure, examples of which are illustrated in the accompanying drawings.

Figure 1:
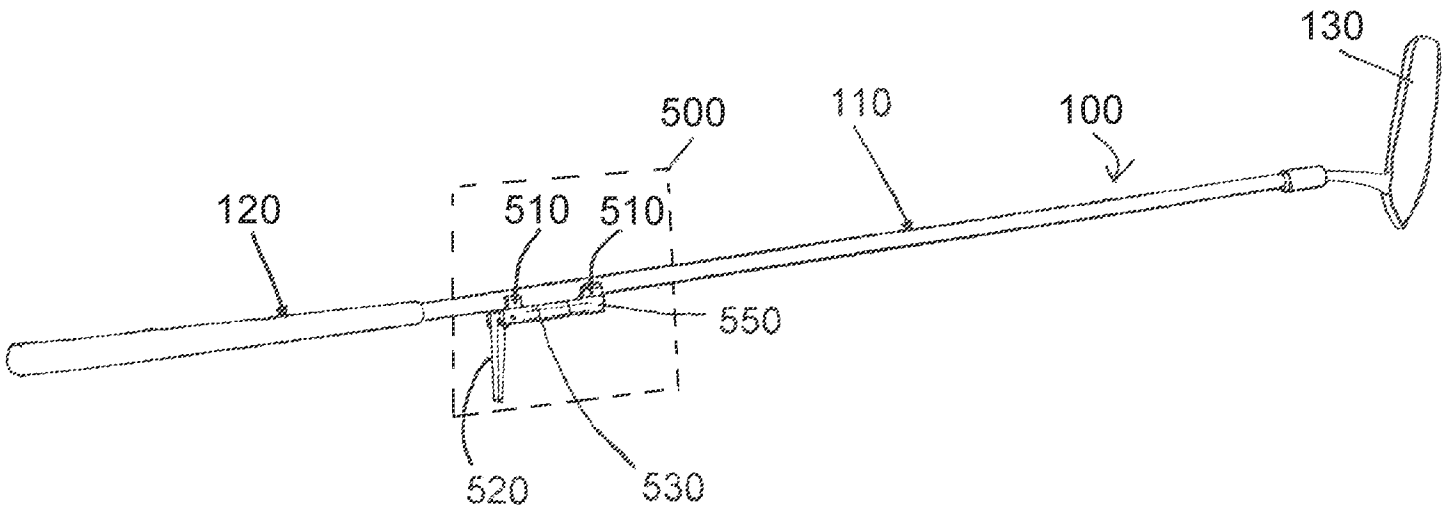
FIG. 1 depicts a golf club stand holding a golf club handle above the ground.

FIG. 1 shows a golf club stand in accordance with an embodiment of the present disclosure. Stand 500 may include a leg housing 550 and a leg 520. Leg 520 may be coupled to one end of leg housing 550 in a manner that allows leg 520 to rotate with respect to leg housing 550. The vertex of the angle of rotation may be located at the point where leg 520 is coupled to leg housing 550. Stand 500 may include a coupling apparatus for attaching stand 500 to a golf club 100. Coupling apparatus may attach leg housing 550 to club shaft 110, and may include all types of apparatus including clips, magnets, adhesives, fasteners such as hook and loop fasteners and the like. Coupling apparatus may be a tool-less coupling apparatus. Tool-less coupling apparatus may attach the leg housing 550 to club shaft 110 with any use of additional tools such as a screw driver, allen wrench or the like.

Stand 500 may be attached to a golf club 100 using clips 510 found at either end of leg housing 550. Stand 500 may be attached to club shaft 110 in a manner that elevates club handle 120 above the ground when leg 520 is in the extended position and club head 130 and leg 520 are resting on the ground. When in an attached position, clips 510 may provide enough grip tension against club shaft 110 so that removing the stand 500 from the club or changing the position or orientation of attachment may require a force greater than the weight of stand 500 or the golf club 100. Clips 510 may be configured to attach stand 500 to golf clubs 100 of varying club shaft diameter without the use of a separate tool such as a screwdriver or an allen wrench.

Stand 500 may be mostly made of plastic materials and a metal spring that may pull leg 520 to rotate inside of leg housing 550 when leg 520 is not being used. The stand 500 may be easily attachable and detachable to a golf club 100 by way of clips 510 located at both of ends of leg housing 550. In addition to or in the alternative to clips 510, the stand may utilize a magnet 530 for purposes of attaching stand 500 to club shaft 110. Said magnet 530 may be located upon the top of the leg housing 550, touching the shaft of the golf club when stand 500 is attached. When in an attached position, magnet 530 may provide enough attractive force so that removing the stand 500 from the club shaft 110 or changing the position or orientation of attachment may require a force greater than the weight of stand 500 or the golf club 100. Magnet 530 may be configured to attach stand 500 to golf clubs 100 of varying club shaft diameter without the use of a separate tool such as a screwdriver or an allen wrench.

Figure 2:
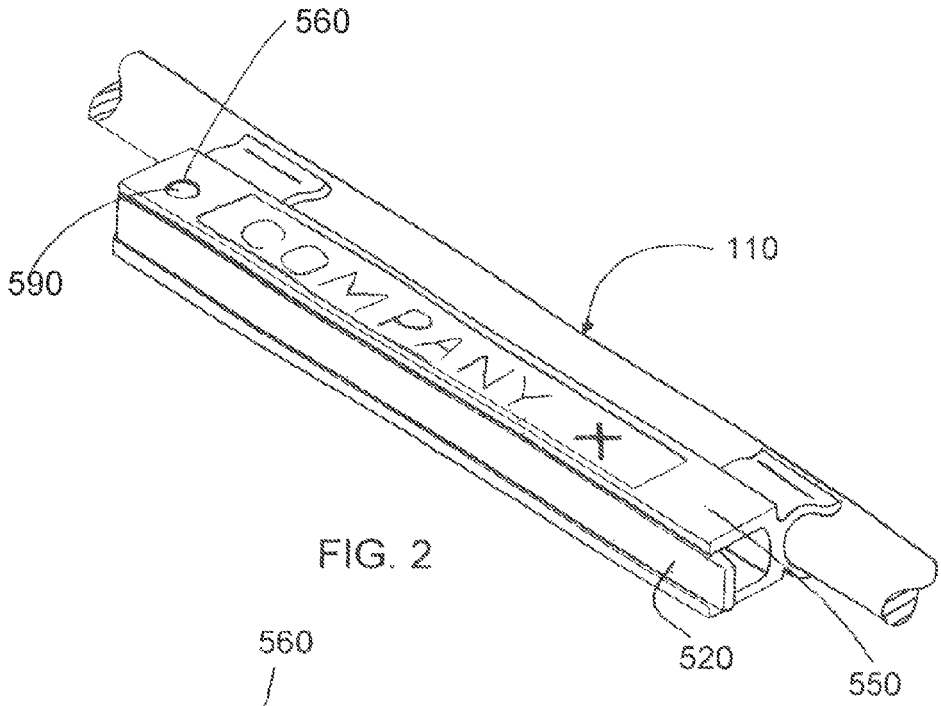
FIG. 2 depicts a close up view of a golf club stand attached to a golf club shaft.

FIG. 2 displays an angled underside view of an embodiment of the invention attached to a club shaft 110. Stand 500 may be attached to club shaft 110 so that connecting stub 590 is positioned on the handle side of club 100 as opposed to the club head side of club 100. Stand 500 may be in a closed position (as shown in FIG. 2) when stand 500 is not being used to support golf club 100. In the closed position, leg 520 of the invention is substantially enclosed within leg housing 550. Leg housing 550 may have a 3 dimensional U-shape as shown in FIG. 2. This closed position may allow the invention to be securely attached to club shaft 110, with minimal protrusions, preventing leg 520 from accidentally contacting surroundings and distracting the golfer during use of the club 100.

Figure 3:
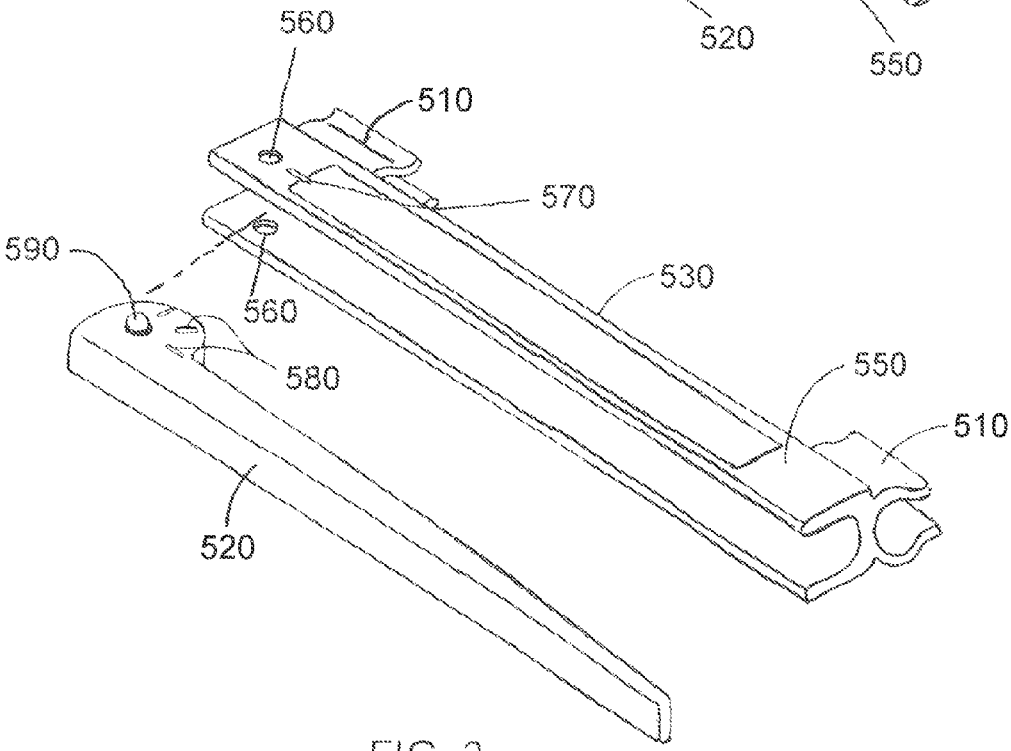
FIG. 3 depicts an exploded view of a golf club stand.

FIG. 3 shows an exploded view of an embodiment of the invention. The leg housing 550 may have two receiving holes 560 that receive connecting stubs 590 of leg 520 to allow for rotational motion of leg 520. Leg 520 may have at least one locking tab 580 that is capable of coupling with a receiving notch 570 contained within the leg housing 550. Coupling of locking tab 580 and receiving notch 570 may secure leg 520 at a certain angle of rotation. The most common angle of choice may be approximately 90 degrees. The leg 520 may taper in width as distance from connecting stub 590 increases.

Figure 4:
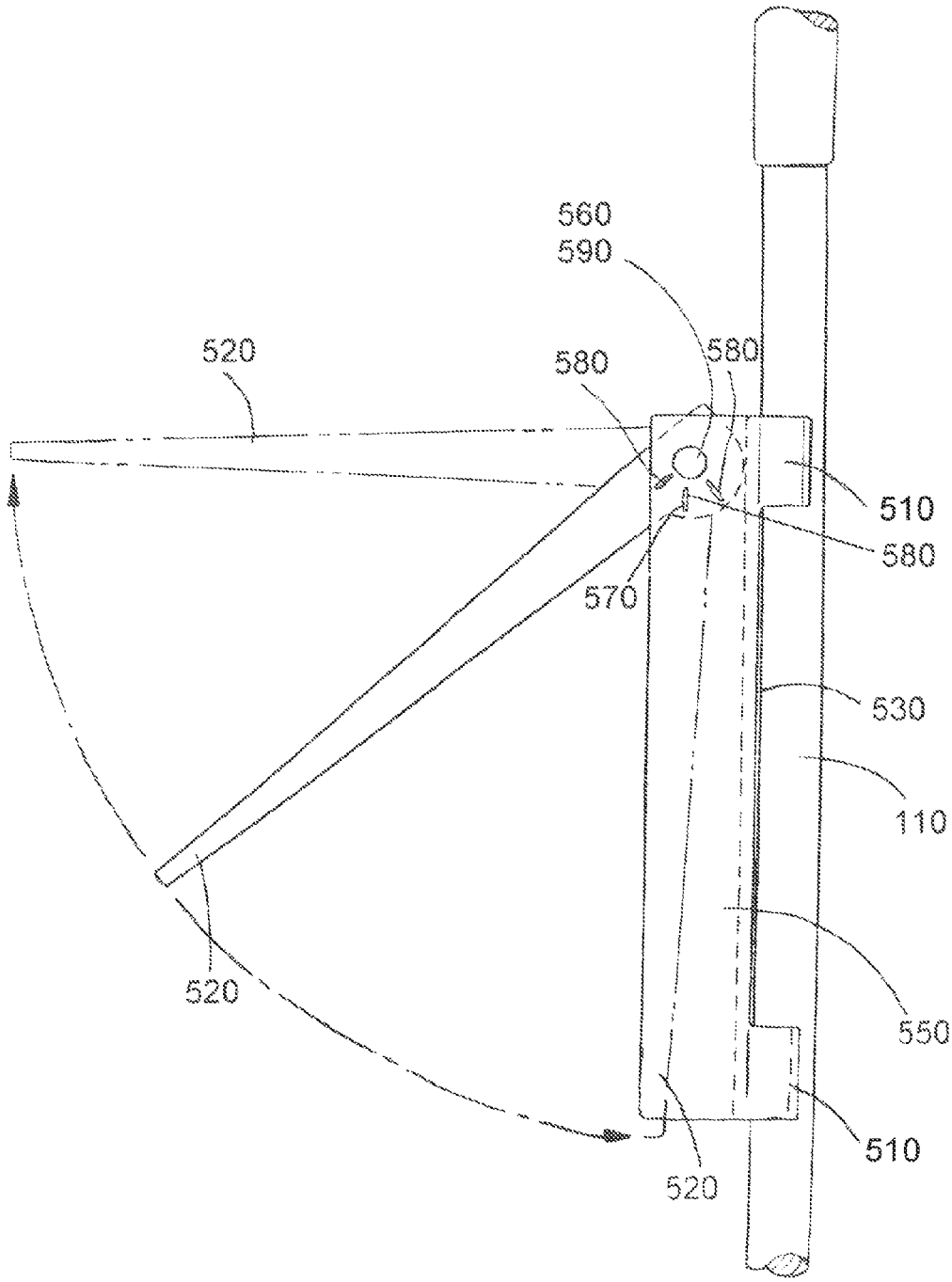
FIG. 4 depicts a golf club stand attached to a golf club shaft demonstrating the freedom of movement of the retractable leg.

FIG. 4 shows stand 500 attached to club shaft 110 in accordance with an embodiment of the invention. Leg 520 may be capable of rotation with respect to leg housing 550.

Figure 5:
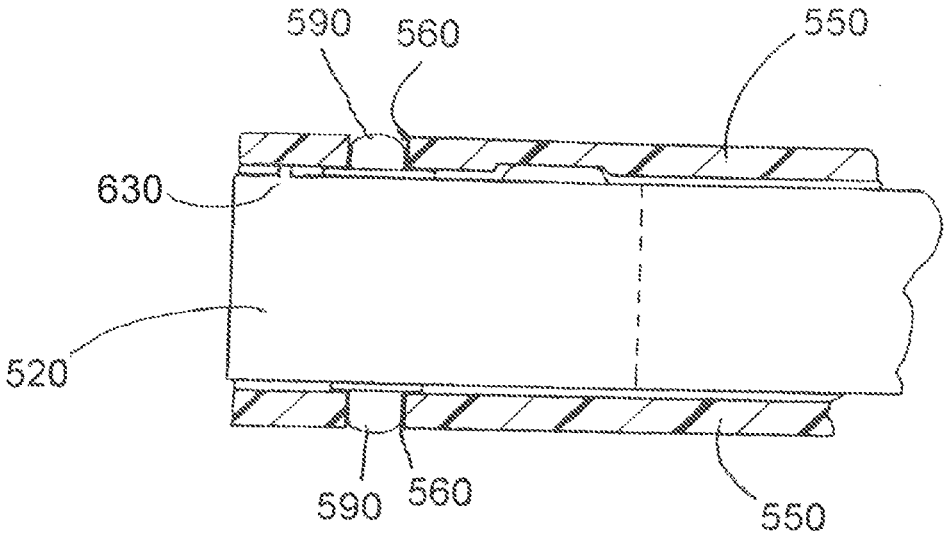
FIG. 5 depicts a close up view of the area where the leg couples with the leg housing.

FIG. 5 shows means for connecting leg 520 to leg housing 550. Connecting stubs 590 may be positioned flush or recessed with respect to receiving holes 560. These connections may allow for the rotation of leg 520 with respect to leg housing 550.

Figure 6:
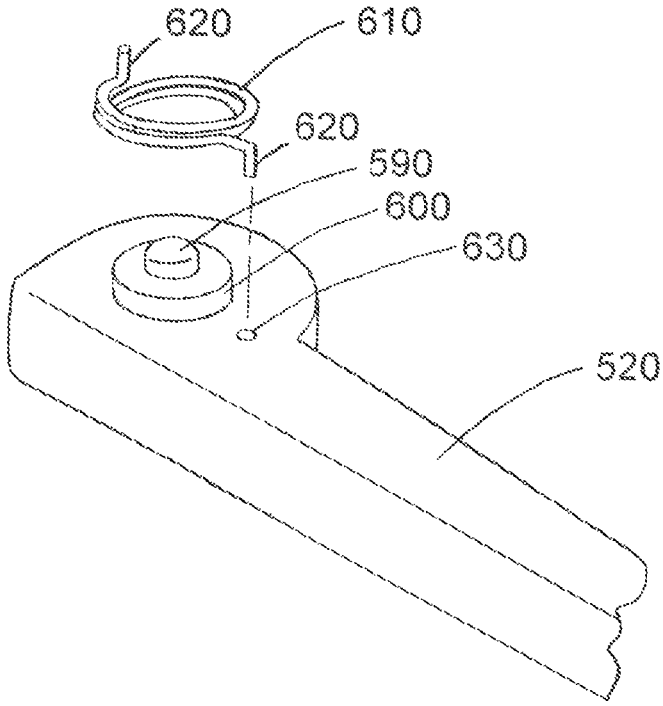
FIG. 6 depicts the leg of the golf club stand and a leg retraction mechanism.

FIG. 6 displays additional features of an embodiment of the invention. The stand may include a leg retraction mechanism which includes a spring, a spring housing, and spring tabs. Spring 610 may be used for automatically retracting leg 520 into leg housing 550 when leg 520 is not in use. Leg 520 may include spring housing 600 which may be a short cylindrical protrusion atop leg 520. Spring 610 may be placed around spring leg housing 600 and between leg housing 550 and leg 520. Spring 610 may be secured to leg 520 and leg housing 550 via at least one spring tab 620. Spring tabs 620 may be inserted into spring holes 630 found on leg 520 and leg housing 550.

Conventional tools for preventing debris or moisture accumulation on the grips of golf clubs include towels and golf club stands. However, use of a towel fails to properly remove excess water and forces the golfer to bring a towel with them as they walk to their ball. Many golfers attach towels to their golf bags. However, when the golfer is standing near the ball the golfer is often not near the golf cart, golf bag, or towel.

Conventional golf club stands can be used to prevent debris from accumulating on a club handle by elevating the handle off of the ground. However, many currently available golf club stands are large, cumbersome, two legged devices that are not easily attachable to a golf club, nor easily detachable. Furthermore, current attachable stands are heavy and can interfere with a golfer's swing by affecting the weight distribution of the club. Existing attachable stands are also not easily attachable to a golf club. This forces the golfer to carry an additional item or items along with the golf clubs, detracting from the enjoyment of the game.

The golf club stand of the present disclosure is a lightweight and inexpensively produced product which may remain attached to the golf clubs during a round of golf without detracting from the ability of the golfer to swing the club. Use of the golf club stand allows easier retrieval of the club because the user is not forced to bend and reach all the way to the ground, place their hands in the grass, which may be wet and/or muddy, and easily access the club.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A golf club stand used for elevating a golf club handle above the ground comprising: a leg housing, a coupling apparatus configured to attach the leg housing to a golf club, and a leg, wherein the leg housing is configured for substantially enclosing the leg within the leg housing, the coupling apparatus is coupled to the leg housing, and the leg is connected at a first end to the leg housing where the leg rotates with respect to the leg housing; wherein the golf club stand further comprises a leg retraction mechanism comprising: at least one spring housing coupled to the leg, at least two spring tabs, and at least one spring; and wherein the leg further comprises at least one spring hole and the leg housing further comprises at least one spring hole, wherein the first spring tab of the at least two spring tabs is coupled with the at least one spring hole of the leg and the second of the at least two spring tabs is coupled with the at least one spring hole of the leg housing.

2. The golf club stand of claim 1, wherein the leg housing further comprises:

at least one receiving hole.

3. The golf club stand of claim 2, wherein the leg further comprises at least one connecting stub.

4. The golf club stand of claim 3, wherein the at least one connecting stub is receivable by the at least one receiving hole.

5. The golf club stand of claim 1, wherein the leg housing further comprises:

at least one receiving notch.

6. The golf club stand of claim 5, wherein the leg further comprises:

at least one locking tab.

7. The golf club stand of claim 6, wherein the at least one locking tab is receivable by the at least one receiving notch.

8. The golf club stand of claim 7, wherein the at least one receiving notch and the at least one locking tab are configured to secure the leg at a certain angle of rotation.

9. The golf club stand of claim 1, wherein the coupling apparatus is a tool-less coupling apparatus.

10. The golf club stand of claim 1, wherein the coupling apparatus is configured for attaching the leg housing to golf clubs of varying shaft diameter.

11. The golf club stand of claim 1, wherein the coupling apparatus for attaching the leg housing to a golf club includes at least one magnet.

12. The golf club stand of claim 1, wherein the coupling apparatus includes at least one clip.

13. The golf club stand of claim 1, wherein the retraction mechanism applies a force to the leg that pulls the leg towards the leg housing.

* * * * *